US006603432B2

(12) United States Patent
Hill et al.

(10) Patent No.: US 6,603,432 B2
(45) Date of Patent: Aug. 5, 2003

(54) LOW PROFILE DUAL-BAND CONFORMAL ANTENNA

(75) Inventors: Robert Hill, Salinas, CA (US); Enrique Ayala, Watsonville, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 10/084,742

(22) Filed: Feb. 21, 2002

(65) Prior Publication Data

US 2003/0001780 A1 Jan. 2, 2003

Related U.S. Application Data

(60) Provisional application No. 60/271,326, filed on Feb. 23, 2001.

(51) Int. Cl.[7] ..... H01Q 1/24; H01Q 1/40

(52) U.S. Cl. ..... 343/702; 343/700 MS; 343/873

(58) Field of Search ..... 343/702, 700 MS, 343/846, 873

(56) References Cited

U.S. PATENT DOCUMENTS 5,952,975 A * 9/1999 Pedersen et al. ..... 343/702
6,025,805 A * 2/2000 Smith et al. ..... 343/702
6,271,794 B1 * 8/2001 Geeraert ..... 343/700 MS

* cited by examiner

*Primary Examiner*—Hoang Nguyen
(74) *Attorney, Agent, or Firm*—Fulbright & Jaworski L.L.P.

(57) ABSTRACT

An antenna assembly including a resonator element having a complex shaped surface topography and discrete edge features disposed at various elevations above a ground plane and which is operatively connected to the ground plane of a wireless communication device (WCD). The resonator assembly may comprise a flexible or deformable resonator support substrate of dielectric material supporting a conductive resonator element or portion. Alternatively, the resonator element may comprise a electrically conducting resonator element formed to retain its complex shape and surface topography. In the latter form, the resonator element may be formed by traditional metal stamping techniques. The complex topography of the resonator element, the discrete resonator segments together provide WCD design flexibility by permitting the antenna assembly to be located at a variety of locations relative to a WCD, including the interior, the exterior, or within a portion of the housing of the WCD itself as long as the resonator element is coupled to the ground plane of a printed wiring board of a WCD. The antenna assembly preferably includes a resonator element comprising a complex substantially hemispherical, or a curving, topography and having a complex set of linear peripheral edge features. In addition, the ground terminal location and the signal feed terminal location are not located along an end region of the complex-shaped resonator element as in traditional planar inverted-F antenna (PIFA) types, but are preferably disposed closely spaced apart in a central region of the resonator element.

19 Claims, 6 Drawing Sheets

| Freq (MHz) | Trace | Beam Peak Deg | Beam Peak dB |
|---|---|---|---|
| 880.00 | ——— | +53.40 | -0.58 |
| 895.00 | ——— | +53.40 | +0.69 |
| 910.00 | ——— | +53.40 | +1.72 |
| 930.00 | ——— | +53.40 | +1.09 |
| 945.00 | – – – – | +53.40 | -0.09 |
| 950.00 | – – – – | +57.78 | -0.53 |

LOW PROFILE DUAL-BAND CONFORMAL ANTENNA

CROSS REFERENCE TO RELATED APPLICATION

This application hereby incorporates by reference and, under 35 U.S.C. §119(e), claims the benefit of priority of U.S. Provisional Patent Application Ser. No. 60/271,326 filed Feb. 23, 2001.

FIELD OF THE INVENTION

The present invention relates to the field of wireless communication and data transfer devices. More particularly, the present invention relates to a new class of embedded antenna designs offering superior directional performance over at least two radio frequency bands and tolerance for diverse polarization angles for incoming signals regardless of the spatial orientation of the portable wireless communication device into which the antenna is embedded.

BACKGROUND OF THE INVENTION

A variety of prior art antenna designs are currently used in wireless communication devices. One type of well known and used antenna design is an external half wave single or multi-band dipole type and another is the planar inverted-F antenna (PIFA) type.

The first type of antenna typically extends or is extensible from the body of a wireless communication device (WCD) in a linear fashion. While this type of antenna is acceptable for use in conjunction with some WCDs, several drawbacks impede greater acceptance and use of such external half wave single or multi-band dipole antennas. One significant drawback is that the antenna is typically mounted at least partially external to the body of a WCD which places the antenna in an exposed position where it may be accidentally or deliberately damaged, bent, broken, or contaminated. Furthermore, due to the physical configuration of this class of antenna, optimizing performance for a particular directional signal. That is, these types of prior art antennas are relatively insensitive to directional signal optimization or, said another way, these types of prior art antennas can operate in a variety of positions relative to a source signal without substantial signal degradation. This performance characteristic is often known as an "omni-directional" quality, or characteristic, of signal receipt and transmission. This means that electromagnetic waves radiate substantially equally in all directions during transmitting operations. Such prior art antennas also are substantially equally sensitive to receiving signals from any given direction (assuming adequate signal strength). Unfortunately, for a hand held WCD utilizing such a prior art antenna, the antenna radiates electromagnetic radiation equally toward a human user of the WCD equipped with such an antenna.

The second type of antenna known as a PIFA design, is operable in a single frequency band and consists of a rectangular metallic plate resonator element disposed above and parallel to a ground plane with a terminal electrically coupled to a ground plane of reduced electrical potential formed at one comer of the rectangular resonator plate and a communication signal feed terminal along an edge of the rectangular resonator plate closely space from the ground terminal. The rectangular resonator plate often has contiguous side panels bent in the direction of the ground plane. The PIFA is electrically connected to circuitry of the WCD to send and receive communication signals in the form of radio frequency (RF) electromagnetic radiation.

There is essentially no so-called "front-to-back ratio" (with respect to a WCD) and little or no reduction in the specific absorption rate (SAR) with this type of prior art antenna design. For reference, a typical SAR value is usually expressed as follows: 2.7 mw/g at a 0.5 watt transmission power level. For further reference, for multi-band versions of prior art types of antenna, the external half wave single or multi-band dipole antenna (i.e., where resonances are achieved through the use of inductor-capacitor (LC) traps), signal gain on the order of approximately a positive two decibels (+2 dBi) are common and expected.

In addition, due mainly to the inherent shape of such prior art antennas, when operating they are typically primarily sensitive to receiving vertical polarization communication signals and may not adequately respond to communication signals that suffer from polarization rotation due to the effects of passive reflection of the communication signals between source and receiver equipment. Furthermore, such prior art antennas are inherently inadequate in sensitivity to horizontal polarization communication signals.

Another type of prior art antenna useful with portable wireless communication gear is an external quarter wave single or multi-band asymmetric wire dipole. This type of antenna operates much like the aforementioned external half-wavelength dipole antenna, but requires an additional quarter wave conductor to produce additional resonances and, significantly, suffers the same drawbacks as the aforementioned half wave single band, or multi-band, dipole antenna.

Therefore, the present invention recognizes and addresses herein a need in the art of antenna design for a WCD for an antenna assembly which is compact and lightweight; that is less prone to breakage and has no moving parts (which may fail, become bent, and/or misaligned), and, which utilizes the available interior spaces and structure of a WCD to achieve a more compact final configuration.

There is also a need for an antenna assembly which is able to receive and transmit electromagnetic frequencies at one or more preselected operational frequency bands.

There is also a need in the art for a deformable antenna resonator which is equally responsive to a variety of different communication signals having a variety of polarization orientations and emanating to and from diverse directions.

There also exists a need in the art for an antenna assembly which is compact and lightweight and which can receive and transmit electromagnetic signals at one or more discrete frequencies and which antenna assembly can be tuned to one or more frequencies.

SUMMARY OF THE INVENTION

The invention herein taught, fully enabled, described and illustrated in detail herein is a low-profile multiple band antenna assembly for use in a compact wireless communication device (WCD) which meets the shortcomings of the prior art. The inventive antenna assembly of the present invention includes a resonator element comprising a complex substantially hemispherical, or a curving, topography and having a complex set of linear peripheral edges. In addition, the ground terminal location and the signal feed terminal location are not located along an end region of the complex-shaped resonator element, and are preferably disposed closely spaced apart in a central region of the complex-shaped resonator element. In one embodiment of a new class of hybrid-PIFA type designs taught herein, the complex-shaped resonator element comprises a film or layer of electrically conducting material formed on a suitable shaped dielectric substrate. In another embodiment of the present invention, the complex resonator element comprises a metallic member formed into suitable complex shape by traditional metal stamping techniques. In yet another embodiment, the complex-shaped resonator element is formed of electrically conducting resin or polymer materials and may be molded, stamped, or thermally treated and pressed into a desired complex shape.

The resonator element may be shaped in a variety of other ways to create a surface topography having a desired three-dimensional contour as compared to traditional planar PIFA designs. The ground plane comprises an electrically conductive region of reduced electrical potential. The ground plane may disposed as a single layer of conductive material, or may comprise several electrically connected layers of conductive material, and typically is disposed on or within a printed wiring board, or other substrate member, used to support diverse electrical circuitry that affect WCD communication.

Herein, the term "resonator element" shall refer generally to the overall complex surface topography of the complex-shaped conductive material and the term "resonator segments" shall refer to the discrete angular edge portions of said resonator element. Many variations of the resonator element and the resonator segments are possible and useful in practicing the present invention, including a wide variety of discrete resonator segments spaced from and disposed relative to the ground plane in a non-parallel orientation.

These resonator segments are preferably spaced at various elevations apart from a ground plane member of a wireless communication device (WCD) and together comprise the resonator element which is preferably curved, or hemispherical, in cross-section and may itself be disposed at a different elevation, or height, with respect to the ground plane member. The precise shape, location, and spacing of the resonator segments relative to the ground plane can be designed and fabricated to optimize response to discrete frequency bands and optimize antenna performance as embedded into diverse housing configurations and in anticipation of the typical manner is which a human operator operates, stores, holds and places a WCD (e.g., a WCD held upright, inverted, covered, uncovered, open, closed, etc.). In addition, the class of inventive antennas taught herein are designed to conform to an interior portion of a compact, low-profile WCD (i.e,. thin or narrow in elevational cross section).

In the present invention, the resonator segments are either disposed on and supported by a substrate or formed of an electrically conductive material, or materials, and arranged and electrically connected to a ground plane associated with the WCD. Whether or not disposed on a substrate, the resonator element is oriented to best capture RF communication signals.

The flexible dielectric support substrate is preferably comprised of a material having suitable dielectric and thermal cycling properties (e.g., non-electrically conducting laminated epoxy, lower temperature ABS material, cyanate ester, polyimides, PTFE, composites, amalgams, resin-based material, ceramic, etc. with due consideration for costs and benefits of each). Some specifications for a dielectric support usable in conjunction with preferred embodiments of the present invention include: a dielectric constant having a magnitude of approximately three (within a range dielectric constant of about 1 to about 20), low loss, and high temperature resilience (with respect to swelling, warping, and the like) during solder reflow during fabrication, and tolerance for thermal cycling generally. A particularly preferred dielectric substrate is produced and distributed by The Dow Chemical Company under the Questra® brand name. This product is a crystalline polymer featuring excellent heat resistance; high tolerance to chemicals and harsh environments; is very moldable; and moisture resistant. Typical applications for this product include automotive connectors, switches, and engine components; electrical connectors; phone jacks; circuit board connectors and the like. With respect to the "deformable" characteristic of the resonator member, said characteristic is useful primarily during manufacture of the antenna assembly of the instant invention and does not contribute generally to the functionality of the resulting antenna assembly. At least during fabrication processing, in the case where the resonator element is disposed on a portion of a deformable dielectric substrate, the substrate should be sufficiently deformable so that after initially forming the complex shape of the substrate, the substrate retains its desired shape. After forming the appropriate shape for the resonator element the conductive resonator element is preferably coupled to the substrate. The resonator element may be formed by: deposition, adhering a conductive film, electo-less plating and/or electo-plating and other techniques as known and used in the art. The resulting antenna assembly clearly may occupy heretofore unusable interior space within a compact, low-profile WCD and permits fabrication of a variety of antenna shapes and configurations depending on such usable interior space within a particular WCD and desired frequency bands for communicating via the WCD. The class of antenna designed and fabricated according to the present invention and for which precise dimensions, illustrations, and performance data is presented herewith (see FIG. 2), operates with superior directional response over the 900 MHz cellular WCD frequency band (i.e., 880 MHz to 960 MHz) and the 1800 MHz personal communication system (PCS) frequency band (i.e,. 1850 MHz to 1990 MHz). The flexibility of preferred substrate material allows for variety in shape so that a wide variety of other frequency bands may be accommodated, including the 2.45 GHz frequency band and others.

An antenna assembly according to the present invention may be attached in many different locations with respect to the WCD, including discrete single or multiple locations disposed in the interior, the exterior, and/or located at discrete locations along the periphery of electronics disposed within a portion of the housing of the WCD, and the like. However, the preferred location is at an upper end of a WCD and more preferably, with a resonator element that is continuously curved, conforming closely to corresponding sloping upper end of a WCD. However, many other configurations are possible and clearly within the purview of those skilled in the art to which the present invention is directed. One such configuration is wherein the resonator element is formed integrally with the exterior housing of a WCD. For example, as one layer of a non-conductive portion of such a housing, such as a polymer or resin-based housing material. If a metallic housing is used generally for a given WCD design, the resonator element may be disposed in a location where opaque or transparent material is used so that no or just nominal RF signal loss occurs near the resonator element. While not preferred, if a metallic housing entirely envelopes a WCD, the resonator element may be attached or mechanically coupled to the exterior of said metallic housing and electrically coupled to the ground plane and the operative WCD signal processing circuitry on the interior. In this integrated WCD housing/antenna assembly the antenna is not technically "embedded" inside the WCD, and thus suitable protective layering or applique may be applied to protect the resonator element and help promote stability to the particular topography of the resonator element and the discrete resonator segments thereof.

As will be appreciated by those of skill in the art to which the invention is directed, the size, shape, physical configuration, electrical and frequency performance characteristics of the antenna assembly will depend in part on the particulars of a given WCD design iteration in view of desired operating frequency (or frequencies), interior dimensions, electrical power constraints, composition of WCD components, and the like. Further, the antenna assembly may be coupled to a WCD at a variety of locations, including the interior, the exterior, within a portion of the housing of the WCD itself, and may be coupled via a suitable antenna interface outlet using conventional components.

It is an object of the present invention to provide a compact antenna assembly designed to be incorporated into a variety of WCDs by conforming to diverse locations in the interior space of such devices.

It is another object of the present invention to reduce the potential for damage and/or breakage of traditional antenna design by reducing external parts to a minimum and firmly mounting antenna assembly components to pre-existing structure of compact WCDs.

It is another object of the present invention to simplify construction of antenna assembly through use of known and traditional antenna, semiconductor, and electronic device fabrication techniques and technologies for production of multiple frequency band antennas.

Accordingly, another feature of the present invention is to provide a compact and effective family of designs for an antenna assembly operable in more than one frequency band.

Yet another feature and advantage of the present invention relates to a family or class of antenna assembly designs capable of conforming to existing structure of a compact WCD into which it is incorporated, including incorporating all components and electrical connections for the antenna assembly during original manufacture of the WCD on a common dielectric substrate member or members supporting the electrical circuit components of the WCD.

Still another feature of the present invention relates to the several effective antenna assembly embodiments thereof having no portion thereof external to the WCD and having no moving parts subject to breakage, wearing out, contamination from external sources, or other loss.

It is an additional object and feature of the present invention to provide an antenna assembly which may be incorporated into a compact, relatively thin WCD package and wherein the resonator element of the antenna assembly conforms to a sloping exterior dimension.

These and other objects, features and advantages will become apparent in light of the following detailed description of the preferred embodiments in connection with the drawings. Those skilled in the art of WCD antenna design will readily appreciate that these drawings and embodiments are merely illustrative and not intended to be limited as to the true spirit and scope of the invention disclosed, taught and enabled herein.

DETAILED DESCRIPTION OF THE PREFERRED EMBODIMENTS

Figure 1A:
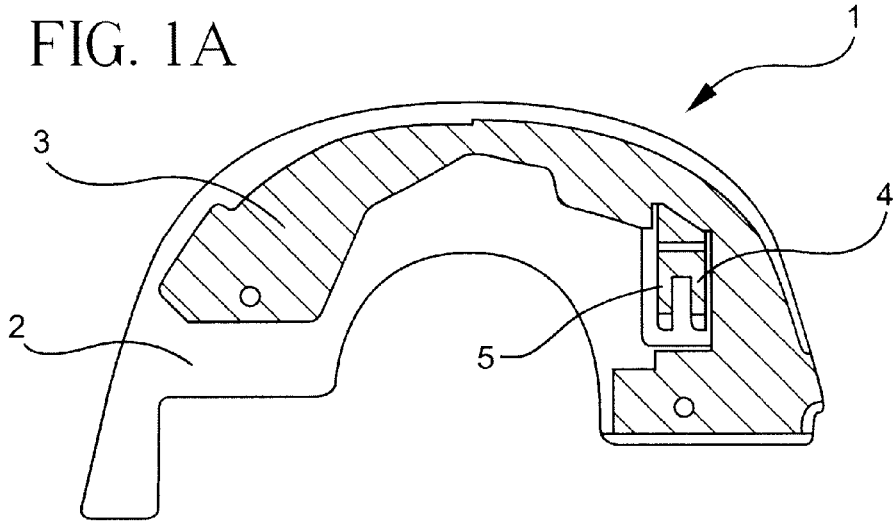
FIG. 1A depicts three discrete views of an antenna resonator assembly designed and fabricated according to the present invention in a plan view, an elevational side view and an elevational side view in cross-section respectively.

Referring now to FIG. 1A which depicts three discrete views of a dual band embodiment of antenna resonator assembly 1 designed and fabricated according to the present invention in a plan view, an elevational side view and an elevational side view in cross-section respectively. In FIG. 1A, a conductive area 3 is disposed on a dielectric support substrate 2 and electrically coupled to a ground plane (not shown individually) via, ground conductor 4 and to a communication signal output of the wireless communication device via center conductor 5. The dielectric constant of substrate 2 may be in the range of between about 1 and 20. Conductive area 3 may have a thickness dimension in the range of one thousandth to seven hundredth of an inch (0.001" to 0.07"). Conductive area and dielectric substrate 2 may have shapes other than as depicted in FIG. 1A an as elsewhere described herein.

Figure 1B:
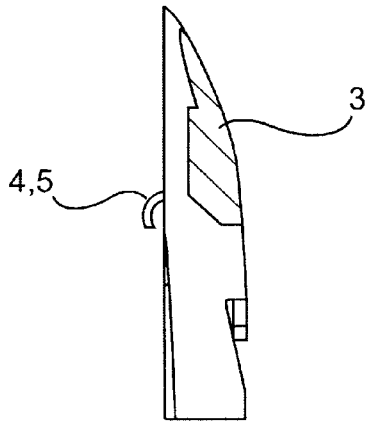
FIG. 1B depicts three discrete views of an antenna assembly (i.e., resonator element electrically coupled to a ground plane) according to the present invention in a plan view and an elevational side view in cross-section respectively.
Figure 1C:
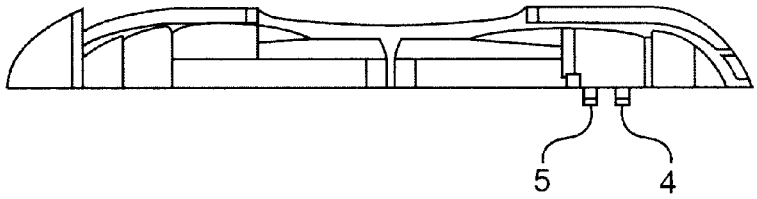
Figure 1D:
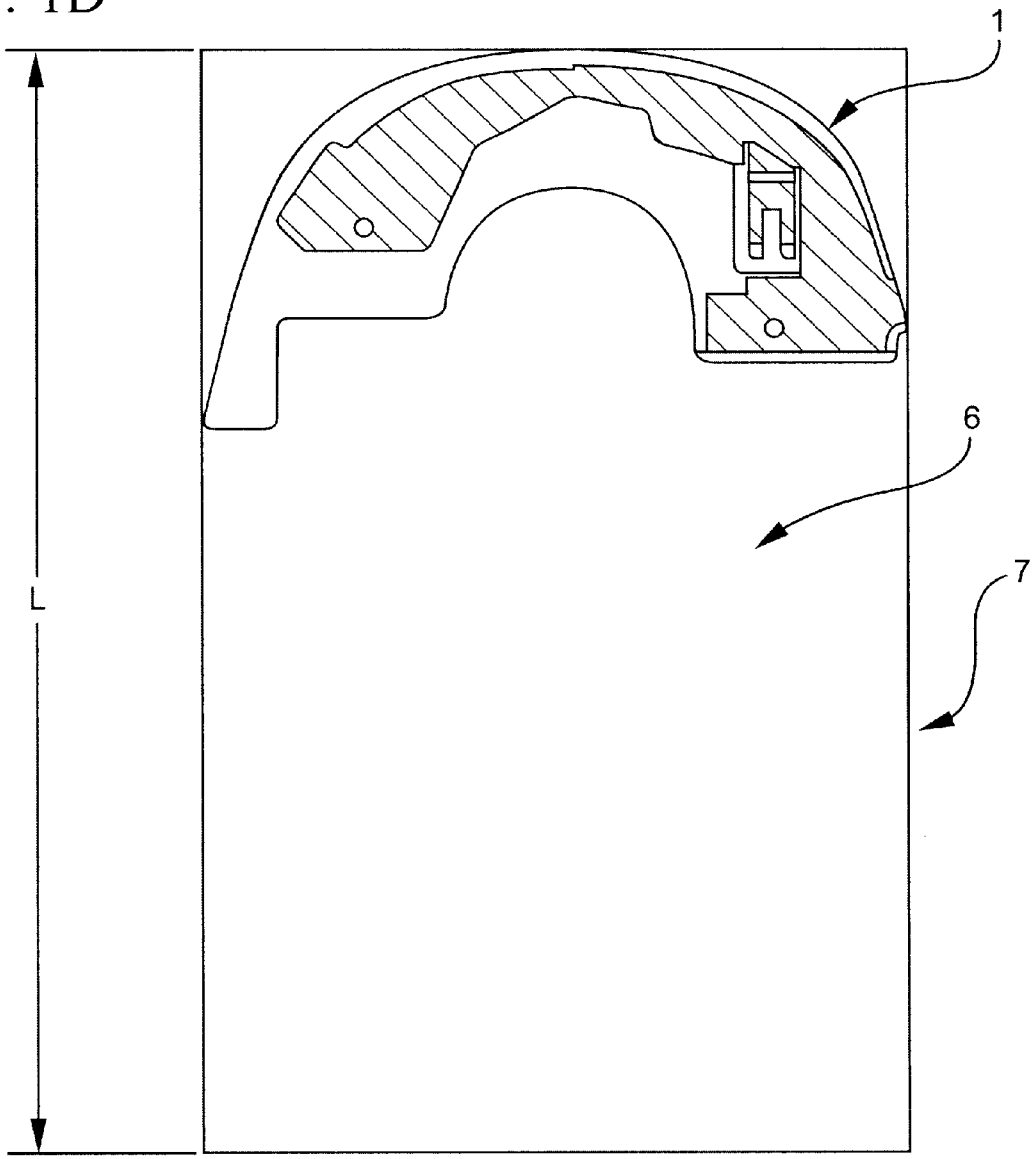
Figure 1E:
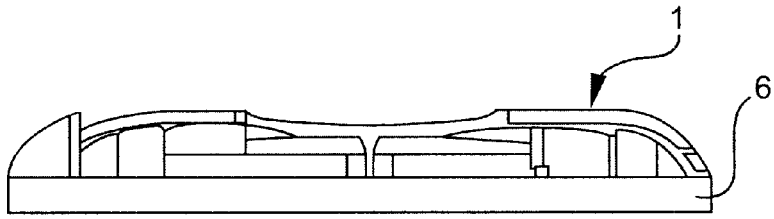

Referring now to FIG. 1B, illustrating three discrete views of an antenna assembly 1 (i.e., resonator element electrically coupled to a ground plane) according to the present invention in a plan view and an elevational side view in cross-section respectively. Specifically in FIG. 1B, resonator assembly 1 is shown attached to a ground plane 6, which may be provided by ground traces on a major printed wiring board (PWB) of a WCD (not separately shown, but more or less contiguous with ground plane 6) functioning as a location of reduced electrical potential. A length dimension "L" is shown in FIG. 1B and has an effective electrical length of one quarter (¼) of the operable wavelength of the communication signals for the WCD. Note that in FIG. 1B, the principal polarization of the antenna depicted will be parallel to the axial direction of the arrow "L" depicting the length dimension.

Figure 2A:
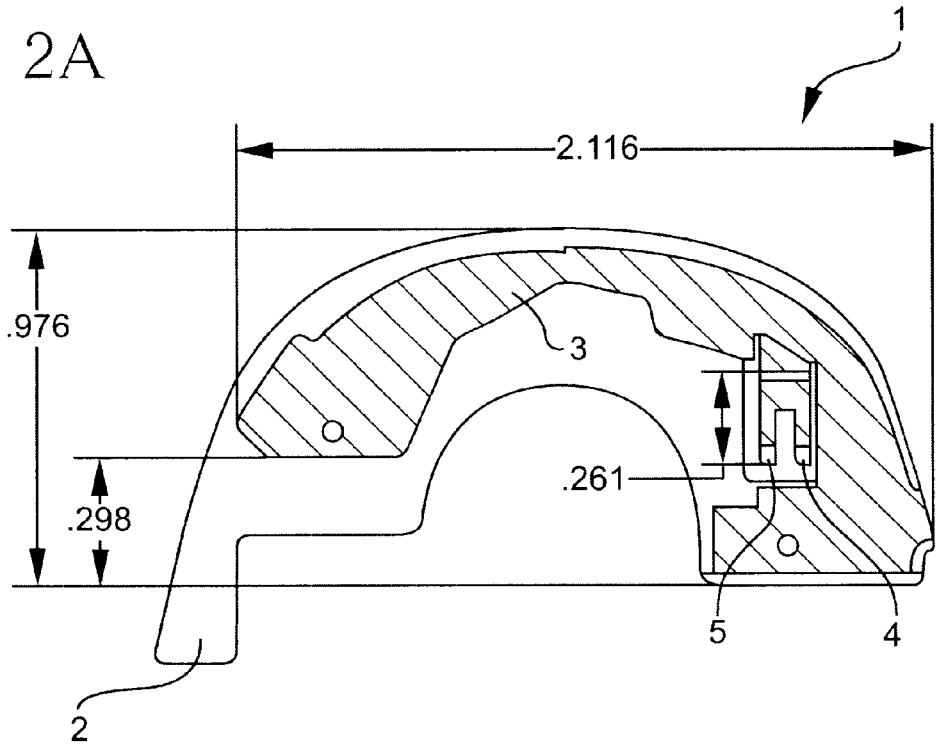
FIG. 2 is a reproduction of FIG. 1A except including preferred dimensions for a resonator element for operating over two frequency bands; namely, 880 MHz to 960 MHz and 1850 MHz to 1990 MHz, and as in FIG. 1A depicted in three discrete views: a plan view, an elevational side view and an elevational side view in cross-section.
Figure 2B:
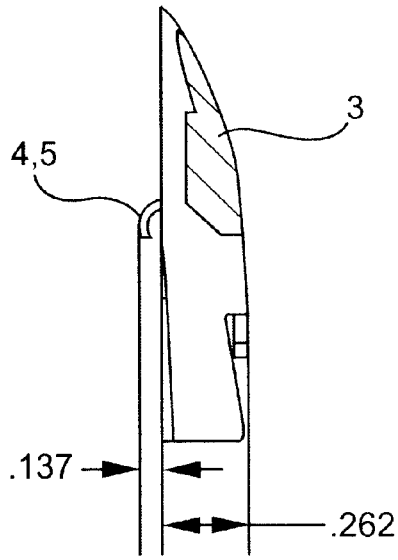
Figure 2C:
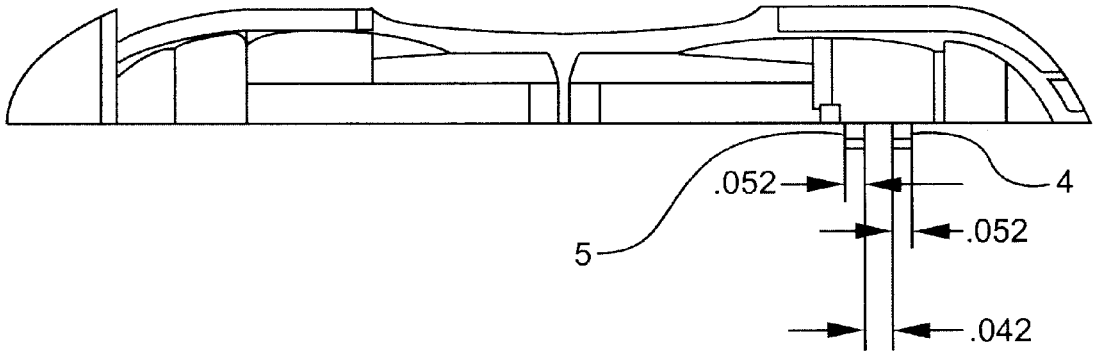

Referring now to FIG. 2 which includes preferred dimensions for a resonator element according to the present invention designed for operation over two frequency bands; namely, 880 MHz to 960 MHz and 1850 MHz to 1990 MHz (and, as in FIG. 1A, depicted in three discrete views: a plan view, an elevational side view and an elevational side view in cross-section) dielectric substrate 2 preferably has a nominal dielectric constant of about 3. The preferred dimensions depicted in FIG. 2 are for the dielectric substrate sold under the Questra® trademark and supplied by The Dow Chemical Company.

An antenna designed according to the present invention was built into a folding or two-piece WCD as shown in FIG.

3A. Resonator assembly 1 is attached to a two-section ground plane 6. Ground plane 6 comprises two conductive layers or traces electrically coupled together across the hinged portions of the WCD.

Figure 3:
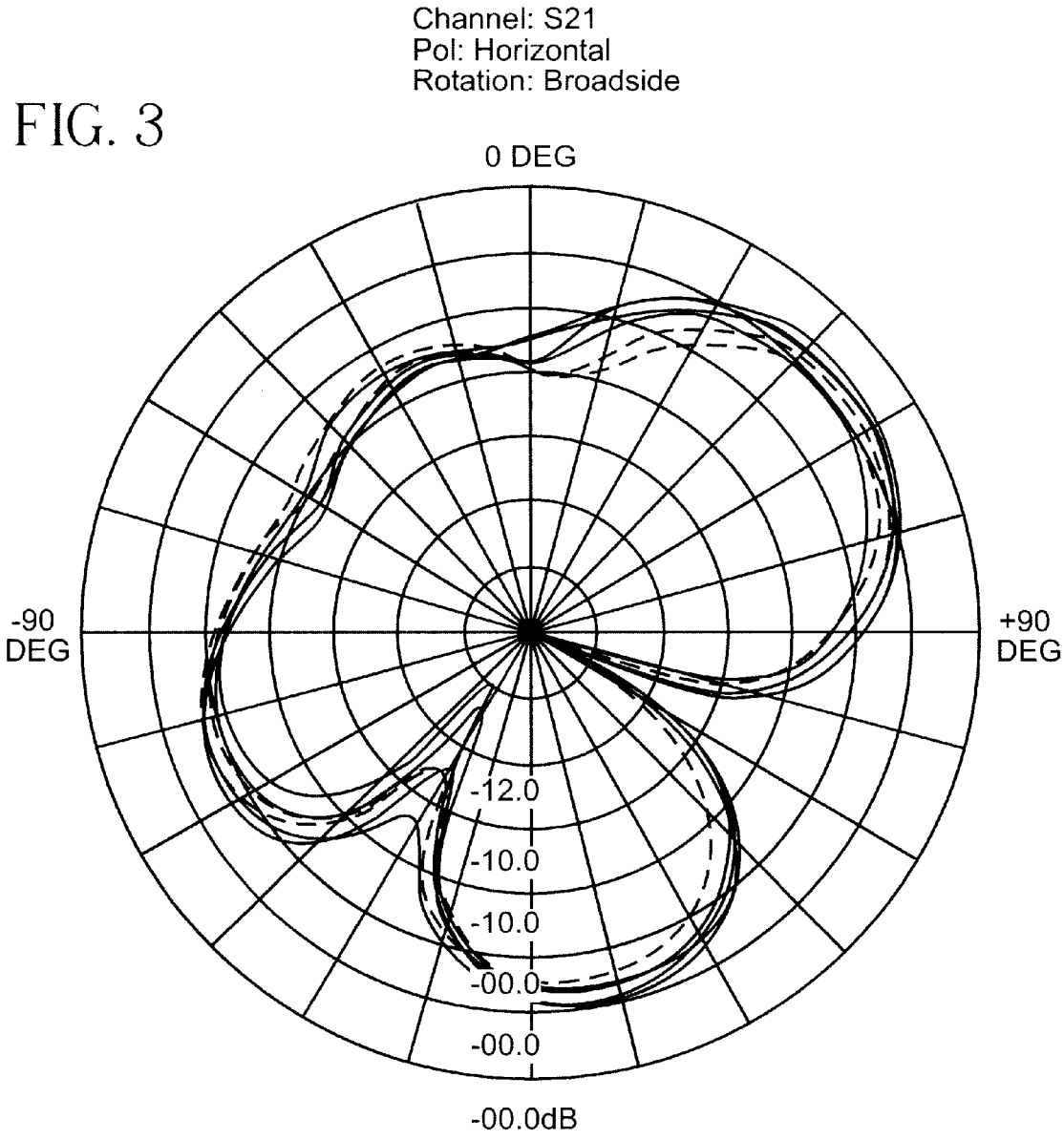
FIG 3 is a graphical representation showing test data from an antenna designed in accordance with the present invention and including: (i) the free-space azimuth pattern and (ii) a table setting forth the signal gain (in decibels) and peak azimuth readings for a discrete ranges of frequencies, all for readings taken "broadside" relative to a WCD in the "open" state and oriented in 3D as depicted in FIG. 3A.
Figure 3A:
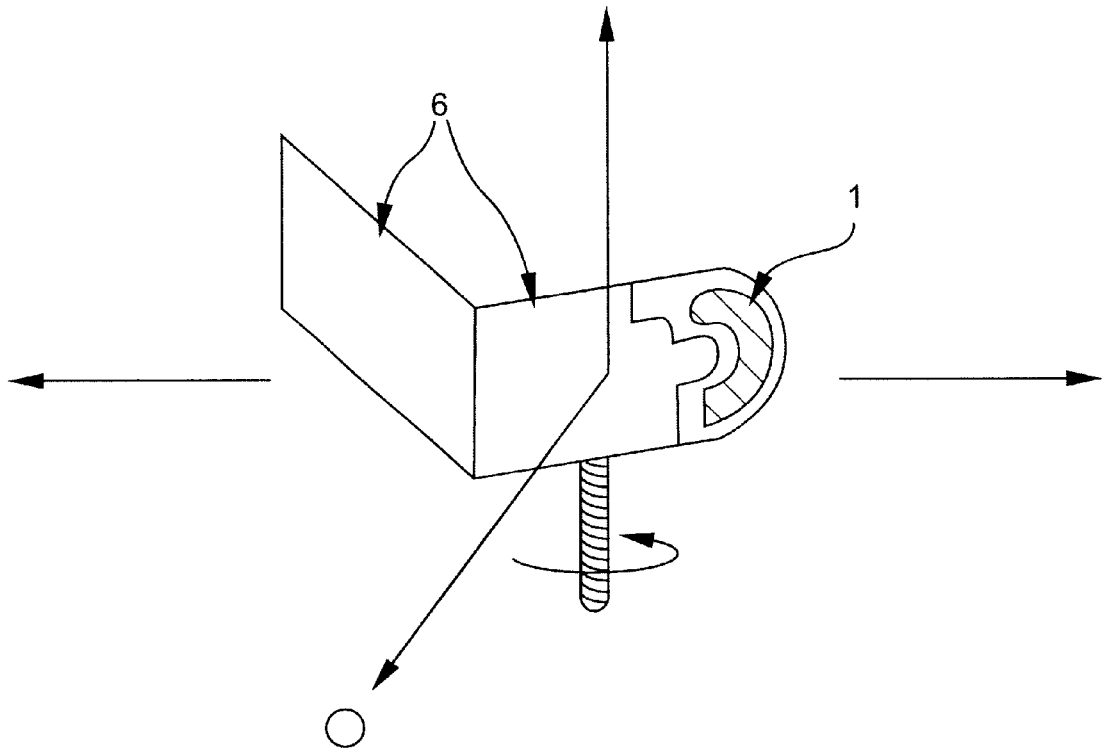

The signal gain and peak azimuth readings were taken over two ranges of frequencies, and the readings were taken "broadside" relative to the WCD in the open position and oriented as shown in FIG. 3A.

In all preferred embodiments herein, an integrated fifty ohm feed is incorporated to couple to traditional 50 ohm coaxial cabling, or equivalent, as is known and used in the art.

Other aspects and advantages of the invention as taught, enabled, and illustrated herein are readily ascertainable to those skilled in the art to which the present invention is directed, as well as insubstantial modifications or additions, all of the above of which falls clearly with the spirit and scope of the present invention as defined and specifically set forth in each individual claim appended hereto. The drawings herein were intended to to illustrate one ore more embodiments of the present invention and were not intended to limit the scope and breadth of the invention hereof, which invention shall be as broad and have reach as defined in the claims appended hereto and in reference to the whole of the disclosure hereof as understood by those of skill in the art of wireless technology generally, and the science and art of antenna and antenna system design, operation, and manufacture.

We hereby claim:

1. A low profile, dual-band conformal antenna assembly for use with a wireless communication device, the antenna assembly comprising:

a thin resonator support substrate having a curving topography;

an electrically conducting layer mechanically supported by the resonator support substrate but having less area than the thin resonator support substrate and with substantially identical curving topography to the thin resonator support substrate;

a ground plane of reduced electrical potential, a first electrical member electrically coupling the electrically conducting element to a output signal source of communication signals; and, a second electrical path electrically coupling the electrically conducting element to the ground plane of reduced electrical potential.

2. The antenna assembly of claim 1, wherein the electrically conducting layer is a metallic film.

3. The antenna assembly of claim 1, wherein the electrically conducting layer has a plurality of straight edge portions and curving edge portions.

4. The antenna assembly of claim 3, wherein at least one of said plurality of straight edge portions and curving edge portions is spaced from the ground plane in a non-parallel configuration.

5. The antenna assembly of claim 4, wherein the plurality of edge portions are tuned to respond to approximately 900 MHz and to 1900 MHz radio frequency signals.

6. The antenna assembly of claim 1, wherein the resonator support substrate is constructed of a deformable dielectric material.

7. The antenna assembly of claim 1, wherein the ground plane is formed as a thin layer of electrically conducting material on a portion of a printed wiring board.

8. The antenna assembly of claim 1, wherein the resonator support substrate has a longitudinal axis and includes opposing major surfaces and the first electrical path electrically couples to the electrically conducting layer near a central location of said electrically conducting layer.

9. The antenna assembly of claim 8, wherein the second electrical path terminates closely spaced from the central location.

10. An antenna assembly in combination with a wireless communication device having a combined signal generating and receiving element and a ground plane, the antenna assembly comprising:

a metal plate resonator element having a major surface and a curved three dimensional topography;

a ground plane of reduced electrical potential;

a conductive portion electrically coupled to the metal plate resonator at a first end and to a communication signal output at a second end;

a second conductive portion electrically coupled to the ground plane of reduced electrical potential at a first end and the metal plate resonator at a second end.

11. The antenna assembly of claim 10, wherein the metal plate resonator has a shaped edge portion.

12. The antenna assembly of claim 11, wherein the shaped edge portion comprises a plurality of curved sections and at least one straight edge portion.

13. The antenna assembly of claim 12, wherein the at least one straight edge portion is disposed at an angle relative to the ground plane.

14. The antenna assembly of claim 10, wherein the metal plate resonator has a longitudinal axis and includes opposing major surfaces, and wherein the metal plate resonator conforms to an interior space of a wireless communication device.

15. An antenna assembly for use with a wireless communication device, the antenna assembly comprising:

a resonator element composed of an electrically conducting material and having a smoothly curving exterior contour surface;

a deformable resonator support substrate supporting the resonator element;

a first electrically conducting connector element;

a second electrically conducting connector element; and, a ground plane;

wherein the first electrically conducting connector element is operatively connected between the resonator element and the ground plane, and the second electrically conducting connector element is operatively connected between the resonator element and a communication signal output of the wireless communication device.

16. The antenna assembly of claim 15, wherein a portion of the flexible resonator support substrate is shaped the same as the smoothly curving exterior contour surface of the resonator element.

17. The antenna assembly of claim 16, wherein the resonator element has a plurality of curved edge portions and at least one straight edge portion.

18. The antenna assembly of claim 17, wherein the at least one straight edge portion is disposed at an angle relative to the ground plane.

19. An antenna assembly for use in an antenna assembly of the type having a ground plane, the antenna assembly comprising:

a resonator element having a complex curvature to a major surface thereof and at least one curved edge portion and at least one straight edge portion;

a flexible resonator support substrate, the flexible resonator support substrate in supporting relation to the resonator element;

a ground plane;

an electrical connector element coupling the resonator element at a first location to the ground plane and coupling the resonator element at a second location to a communication signal output.

* * * * *